US010412993B2

(12) United States Patent
Melvin et al.

(10) Patent No.: US 10,412,993 B2
(45) Date of Patent: Sep. 17, 2019

(54) CIGAR HOLDER ASSEMBLY FOR A SMOKE MACHINE

(71) Applicant: ALTRIA CLIENT SERVICES LLC, Richmond, VA (US)

(72) Inventors: Matthew S. Melvin, Richmond, VA (US); Karl A. Wagner, Glen Allen, VA (US); Dariusz Masiarz, Glen Allen, VA (US)

(73) Assignee: Altria Client Services LLC, Richmond, VA (US)

( * ) Notice: Subject to any disclaimer, the term of this patent is extended or adjusted under 35 U.S.C. 154(b) by 210 days.

(21) Appl. No.: 15/647,945

(22) Filed: Jul. 12, 2017

(65) Prior Publication Data

US 2019/0014817 A1 Jan. 17, 2019

(51) Int. Cl.

| | |
|---|---|
| ***A24F 13/08*** | (2006.01) |
| ***A24F 13/06*** | (2006.01) |
| ***A24D 3/04*** | (2006.01) |
| ***A24F 13/16*** | (2006.01) |
| ***A24C 5/34*** | (2006.01) |
| *A24D 3/16* | (2006.01) |

(52) U.S. Cl.

CPC ..... *A24F 13/08* (2013.01); *A24C 5/34* (2013.01); *A24D 3/04* (2013.01); *A24F 13/06* (2013.01); *A24F 13/16* (2013.01); *A24D 3/166* (2013.01)

(58) Field of Classification Search

None

See application file for complete search history.

(56) References Cited

U.S. PATENT DOCUMENTS

| | | | |
|---|---|---|---|
| 3,258,117 | A | 6/1966 | Domeck, Jr. et al. |
| 3,386,281 | A | 6/1968 | Menge et al. |
| 3,433,054 | A | 3/1969 | Mutter |

(Continued)

FOREIGN PATENT DOCUMENTS

| | | | |
|---|---|---|---|
| GB | 1271838 | A | 4/1972 |
| GB | 1356012 | A | 6/1974 |

(Continued)

OTHER PUBLICATIONS

Cerulean—Data Sheet: "CR20i—20 Channel Rotary Smoking Machine"; http://www.cerulean.com/product-services/tobacco/smoking-machines/rotary-smoking/cr20i; 2 pages, printed Mar. 13, 2017.

(Continued)

*Primary Examiner* — Michael J Felton
*Assistant Examiner* — Katherine A Will
(74) *Attorney, Agent, or Firm* — Buchanan Ingersoll & Rooney PC

(57) ABSTRACT

A cigar holder assembly includes a filter holder that includes: a first filter holder piece having a first end to connect to a smoking machine and a second end, and a second filter holder piece having a first end and a second end, a first opening extending axially into the first end and a second opening extending axially into the second end, and the second end of the first filter holder piece and the first end of the second filter holder piece fit together. The assembly includes a cigar holder having a first end and a second end to receive a cigar, and the second end of the second filter holder piece and the first end of the cigar holder fit together; and a seal has an opening that extends through its entire thickness, the seal configured to fit in the opening in the first end of the cigar holder.

19 Claims, 9 Drawing Sheets

(56) References Cited

U.S. PATENT DOCUMENTS

| | | | |
|---|---|---|---|
| 3,769,832 | A | 11/1973 | Baier |
| 3,914,989 | A | 10/1975 | Reuland et al. |
| 4,019,366 | A | 4/1977 | Claflin et al. |
| 4,069,704 | A | 1/1978 | Grant, Jr. et al. |
| 4,127,025 | A | 11/1978 | Mills et al. |
| 4,171,635 | A | 10/1979 | Calleson et al. |
| 4,184,360 | A | 1/1980 | Vadnay et al. |
| 4,246,774 | A | 1/1981 | Flesselles et al. |
| 4,341,109 | A | 7/1982 | Evans, Jr. |
| 4,400,972 | A | 8/1983 | Wiethaup |
| 4,403,501 | A | 9/1983 | Pezzi |
| 4,429,567 | A | 2/1984 | Koch |
| 4,517,829 | A | 5/1985 | Krappitz et al. |
| 4,528,841 | A | 7/1985 | Siems |
| 4,589,775 | A | 5/1986 | Milhous, Jr. et al. |
| 4,627,448 | A | 12/1986 | Kamm et al. |
| 4,630,466 | A | 12/1986 | Berlin |
| 4,858,628 | A | 8/1989 | Norman et al. |
| 4,912,964 | A | 4/1990 | Ohtsuki et al. |
| 5,117,845 | A | 6/1992 | Poulet et al. |
| 5,369,985 | A | 12/1994 | Koch |
| 5,369,986 | A | 12/1994 | Koch |
| 5,471,866 | A | 12/1995 | Griffiths et al. |
| 5,490,526 | A | 2/1996 | Irikura |
| 6,134,948 | A | 10/2000 | Fuchigami et al. |
| 6,397,663 | B1 | 6/2002 | Chatelet |
| 7,926,324 | B2 | 4/2011 | Kida |
| 2006/0096356 | A1 | 5/2006 | Wilson et al. |
| 2008/0022756 | A1 | 1/2008 | Wilson et al. |
| 2008/0257368 | A1 | 10/2008 | Wilson et al. |

FOREIGN PATENT DOCUMENTS

| | | | |
|---|---|---|---|
| GB | 2183136 | A | 6/1987 |
| WO | 9604808 | A1 | 2/1996 |
| WO | 2006090158 | A1 | 8/2006 |

OTHER PUBLICATIONS

Cerulean—Data Sheet: "CR20ie—20 Channel Rotary Smoking Machine with Enclosed Hood"; http://www.cerulean.com/product-services/tobacco/smoking-machines/rotary-smoking/cr20ie; 2 pages, printed Mar. 13, 2017.

Cerulean—Data Sheet: "Orbit 20—20 Channel Rotary Smoking Machine"; http://www.cerulean.com/media/634919/Orbit-20-C2017.pdf; 2 pages, printed Mar. 13, 2017.

Cerulean—Data Sheet: "Beedi Holder—Accessories for Holding Beedies During Analytical Smoking"; http://www.cerulean.com/media/634937/Beedi-Holder-B2017.pdf; 2 pages, printed Mar. 13, 2017.

Cerulean—Data Sheet: "SM405—Manually Operated 5 Port Linear Smoking Machine"; http://www.cerulean.com/product-services/tobacco/smoking-machines/linear-smoking/sm405-5-channel; 2 pages, printed Mar. 13, 2017.

Cerulean—Data Sheet: "SM410-CV—10 Channel Smoking Machine for Cigar Smoking"; http://www.cerulean.com/media/635309/SM410-CV-C2017.pdf; 2 pages, printed Mar. 13, 2017.

Cerulean—Data Sheet: "SM450-CV—20 Channel Linear Smoking Machine for Cigar"; http://www.cerulean.com/media/635318/SM450-CV-C2017.pdf; 2 pages, printed Mar. 13, 2017.

Cerulean—Data Sheet: "100% Vent Blocking Holder B:2017—Accessories for Intense Smoking Regimes"; http://www.cerulean.com/media/634934/100-Vent-blocking-holders-B2017.pdf; 2 pages, printed Mar. 13, 2017.

Borgwaldt—"Smoking Machine RM200A2"; http://borgwaldt.hauni.com/en/instruments/smoking-machines/rotary/smoking-machine-rm200a2.html; 2 pages, printed Mar. 13, 2017.

Borgwaldt, Körber Solutions; "LM4C Linear Smoking Machine for Cigars"; http://borgwaldt.hauni.com/en/instruments/smoking-machines/modular-smoking-machines/smoking-machine-lm4c.html; 1page, printed Mar. 13, 2017.

Borgwaldt, Körber Solutions; "Smoking Machine LX20"; http://borgwaldt.hauni.com/en/instruments/smoking-machines/linear/smoking-machine-lx20.html; 2 pages, printed Mar. 13, 2017.

Cerulean—Mason, Tim et al., "Higher Yield Product Smoking, Are There Yield Errors Inherent When Using a Mechanical Smoking Machine?"; http://www.cerulean.com/media/315662/Higher-yield-product-smoking.pdf; 6 pages, Printed Mar. 13, 2017.

Baker, Richard, "The Development and Significance of Standards", British American Tobacco, Research & Development Centre, Southampton, U.K., Beitrager zur Tabakforschung International—Contribution to Tobacco Research, vol. 20, No. 1, Feb. 2002, pp. 1-21.

Ghosh, David et al., "An Improved Cambridge Filter Pad Extraction Methodology to Obtain More Accurate Water and "Tar" Values: In Situ Cambridge Filter Pad Extraction Methodolgy", Beitrager zur Tabakforschung International—Contribution to Tobacco Research, vol. 26, No. 2, Jul. 2004, pp. 38-49.

Dixon, Michael et al., "Recent Advances in the Application and Understanding of Alternative Smoking Regimes", British American Tobacco, London, UK, Rec. Adv. Tob. Sci., vol. 32, No. 3-83, 24 pages, printed Mar. 13, 2017.

Coresta Recommended Method No. 64—"Routine Analytical Cigar-Smoking Machine Specifications, Definitions and Standard Conditions", https://www.coresta.org/sites/default/files/technical_documents/main/CRM_64.pdf; Nov. 2005, pp. 1-12, printed Mar. 13, 2017.

Coresta Recommended Method No. 65—"Determination of Total and Nicotine-Free Dry Particulate Matter Using a Routine Analystical Cigar-Smoking Machine-Determination of Total Particulate Matter and Preparation for Water and Nicotine Measurements", https://www.coresta.org/sites/default/files/technical_documents/main/CRM_65-update%28June10%29.pdf; Jun. 2010, pp. 1-16, printed Mar. 13, 2017.

Section A:A

CIGAR HOLDER ASSEMBLY FOR A SMOKE MACHINE

BACKGROUND

During use of automatic smoking machines, one end of a cigar holder assembly is used to hold the mouth-end of a cigar and the opposite end of the cigar holder connects to a smoking machine. Linear and rotary smoking machines are used for the analytical testing of cigars wherein Cambridge filter pad holders mounted on the smoking machine support cigars undergoing testing. For example, rotary and linear smoking machines are available from Cerulean, a company located in the United Kingdom, wherein cigars are held in a holder which includes a vacuum actuated flexible sleeve which grips the wrapper of a cigar. There is a need for a cigar holder assembly that has a leak-free seal on the cigar and that can be easily set up with the smoking machine.

SUMMARY

One embodiment is directed to a cigar holder assembly configured to connect to a smoking machine. The cigar holder assembly includes a filter holder, a cigar holder and a seal. The filter holder includes: a first filter holder piece having a first end that is configured to connect to a smoking machine and a second end that is opposite the first end, and an axially extending opening between the first end and the second end, and a second filter holder piece having a first end and a second end that is opposite the first end, a first opening extending axially into the first end and a second opening extending axially into the second end, and the second end of the first filter holder piece and the first end of the second filter holder piece configured to fit together to form a chamber for a filter. The cigar holder includes a first end and a second end that is configured to receive a cigar having a tipped end, the second end is opposite to the first end, an axially extending opening between the first end and the second end, and the second end of the second filter holder piece and the first end of the cigar holder configured to fit together. The seal is cylindrically shaped and has an axially extending opening in the center thereof that extends through the entire thickness of the seal, the seal configured to fit in the opening in the first end of the cigar holder, and the opening in the seal configured to support a tipped end of a cigar.

Another embodiment is directed to a cigar holder including: a first end that has an opening that is configured to receive a seal that is cylindrically shaped; a second end that has an opening that is configured to receive a cigar, wherein the second end is opposite to the first end; a base portion that is located at the first end, an outer surface of the base portion has a circumferential groove configured to receive an O-ring; a lipped portion that is located at the second end; and a tapered portion that is located in between the base portion and the lipped portion. The tapered portion has an outer periphery which becomes smaller in a direction towards the lipped portion, and the first end is configured to fit within an opening in a filter holder.

These and other exemplary features and advantages of particular embodiments of the cigar holder assembly will now be described by way of exemplary embodiments to which they are not limited.

BRIEF DESCRIPTION OF THE DRAWINGS

The scope of the present disclosure is best understood from the following detailed description of exemplary embodiments when read in conjunction with the accompanying drawings.

Further areas of applicability of the present disclosure will become apparent from the detailed description provided hereinafter. It should be understood that the detailed description of exemplary embodiments are intended for illustration purposes only and are, therefore, not intended to necessarily limit the scope of the claims.

DETAILED DESCRIPTION

The claimed subject matter may include combinations of example embodiments in whole or in part. In general, terminology may be understood at least in part from usage in context. For example, terms, such as "and," "or," or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, terms such as "a," "an," or "the," may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. In this specification, when a numerical value is mentioned such as for a distance, diameter, etc., a variance of ±10% is contemplated for that numerical value.

Figure 1A:
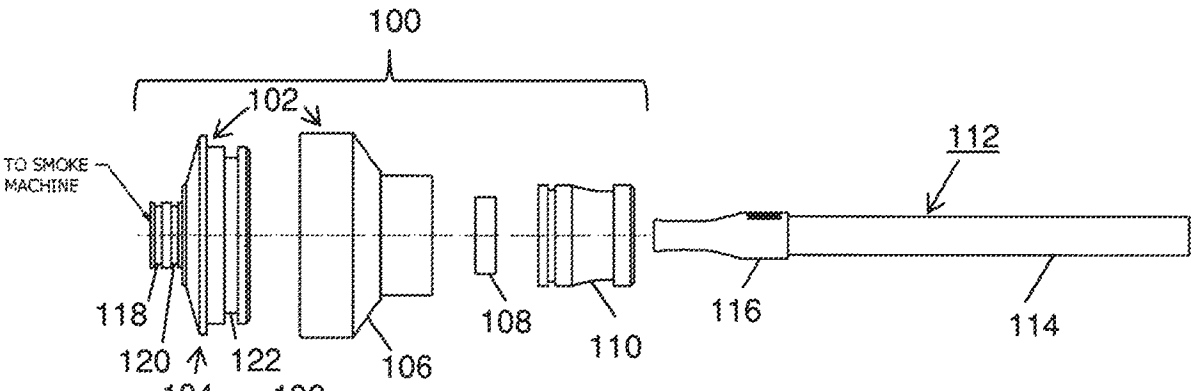
FIGS. 1A-1C illustrate a cigar holder assembly in accordance with an exemplary embodiment.
Figure 8:
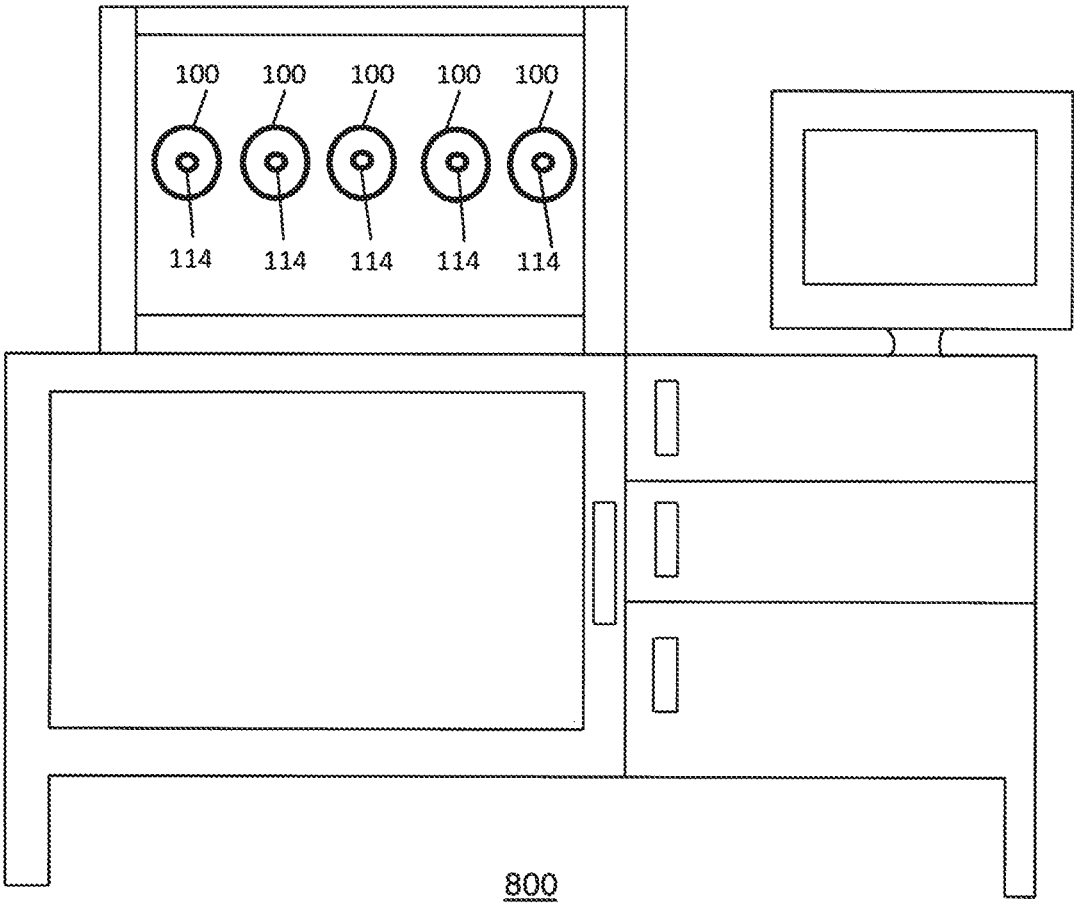
FIG. 8 illustrates a smoking machine in accordance with an exemplary embodiment.

FIG. 1A shows an exploded view of the various components of a cigar holder assembly 100 in accordance with an embodiment wherein the cigar is held without using a vacuum activated flexible sleeve. FIG. 1A also shows a tipped cigar 112 that consists of a tipped portion 116 that is made of, for example, wood, plastic, or any other material or combination of materials, and a cigar 114 to which the tipped portion 116 is attached. The cigar holder assembly 100 is configured to connect to a smoking machine that is used for the analytical testing of cigars. For example, a rotary or linear smoking machine from Cerulean. An exemplary smoking machine 800 is shown in FIG. 8, which is a five port linear smoking machine in which five cigar holder assemblies are connected to the smoking machine 800. The cigar holder assembly 100 can be used with smoking machines of various configurations (e.g., linear, rotary, etc.) and having any number of ports (e.g., five, ten, twenty, etc.). The cigar holder assembly 100 includes, for example, a filter holder 102, a seal 108, and a cigar holder 110. The disclosed cigar holder assemblies provide a reduced set-up time as compared to conventional cigar holders, and also provide a leak-free seal of the cigar.

In an exemplary embodiment, the filter holder 102 includes a first filter holder piece 104 and a second filter holder piece 106. The filter holder 102 is not limited to two pieces, and could be three or more pieces. The first filter holder piece 104 shown in FIGS. 2A-2C has a first end 200 that is configured to connect to a smoking machine 800. The first filter holder piece 104 connects to the smoking machine 800 via a neck portion 204 that fits into an orifice (port) of the smoking machine 800. The first filter holder piece 104 has a second end 202 that is opposite the first end 200. The first filter holder piece 104 also has an axially extending opening 220 between the first end 200 and the second end 202. The axially extending opening 220 is circularly shaped. The first filter holder piece 104 will be discussed in greater detail later.

Figure 3C:
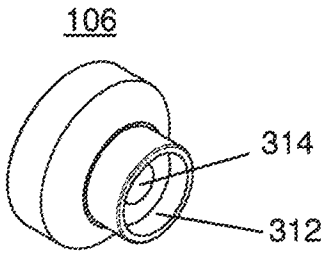
FIGS. 3A-3C illustrate a second filter holder piece in accordance with an exemplary embodiment.
Figure 3B:
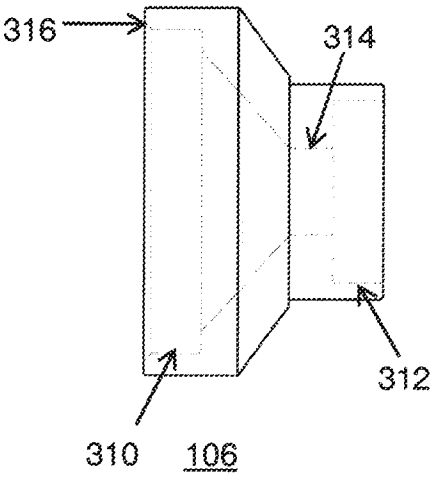
Figure 3A:
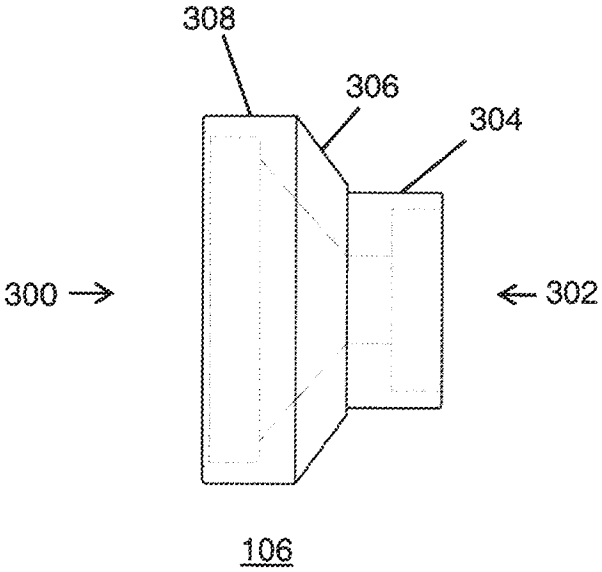

In an exemplary embodiment, the second filter holder piece 106 shown in FIGS. 3A-3C has a first end 300 and a second end 302 that is opposite the first end 300. The second filter holder piece 106 also has a first opening 310 extending axially into the first end 300 and a second opening 312 extending axially into the second end 302. The first opening 310 and the second opening 312 are circularly shaped. The second end 202 of the first filter holder piece 104 and the first end 300 of the second filter holder piece 106 are configured to fit together to form a chamber for a filter. The second filter holder piece 106 will be discussed in greater detail later. The filter can be, for example, a circular Cambridge filter pad having a diameter of 44 mm, a circular Cambridge filter pad having a diameter of 55 mm, or a circular Cambridge filter pad having any other diameter. For example, the circular Cambridge filter pad could have any diameter between 35 mm and 65 mm. The first filter holder piece 104 and the second filter holder piece 106 can be provided with various dimensions selected/scaled based on the diameter of the intended filter pad to be used with the filter pad holder 102.

Figure 5C:
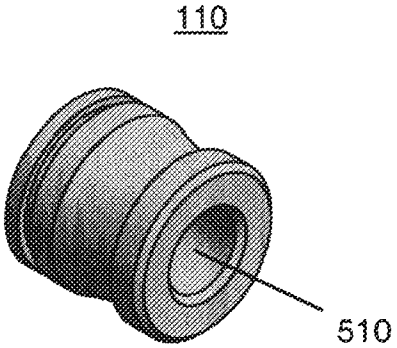
FIGS. 5A-5C illustrate a cigar holder in accordance with an exemplary embodiment.
Figure 5B:
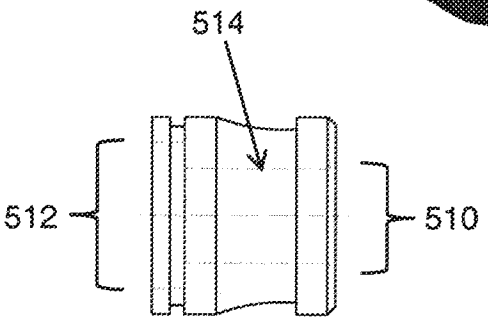
Figure 5A:
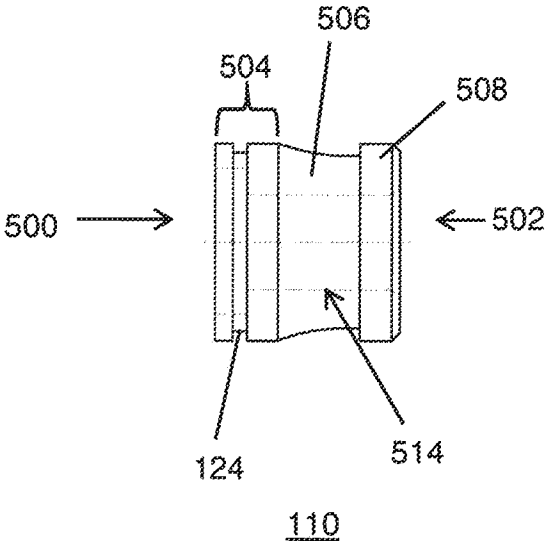

The cigar holder 110 shown in FIGS. 5A-5C has a first end 500 and a second end 502 that is configured to receive a cigar having a tipped end 116. The second end 502 is opposite to the first end 500. An axially extending opening 514 is located between the first end 500 and the second end 502. The axially extending opening 514 is circularly shaped. The second end 302 of the second filter holder piece 106 and the first end 500 of the cigar holder 110 are configured to fit together. The cigar holder 110 will be discussed in greater detail later.

In an exemplary embodiment, the seal 108 shown in FIGS. 4A-4F is cylindrically shaped and has an axially extending opening 400, 408 in the center thereof that extends through the entire thickness 402 of the seal 108. The seal 108 is configured to fit in the opening 512 in the first end 500 of the cigar holder 110. For, example, the seal 108 can fit in the opening 512 so that the seal 108 is completely surrounded by the cigar holder 110 in a manner in which the seal 108 does not protrude from the first end 500 of the cigar holder 110 when the seal 108 is inserted all the way into the opening 512. Alternatively, the seal 108 can protrude from the first end 500 of the cigar holder 110 when the seal 108 is inserted all the way into the opening 512. The opening 400, 408 in the seal 108 is configured to support and seal around the tipped end 116 of a cigar. The seal 108 will be discussed in greater detail later.

Figure 2C:
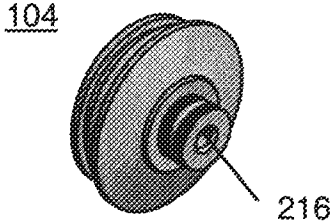
FIGS. 2A-2C illustrate a first filter holder piece in accordance with an exemplary embodiment.
Figure 2B:
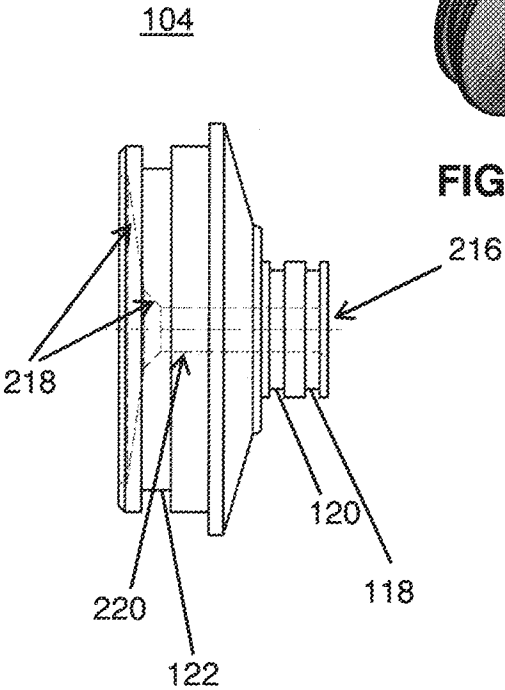
Figure 2A:
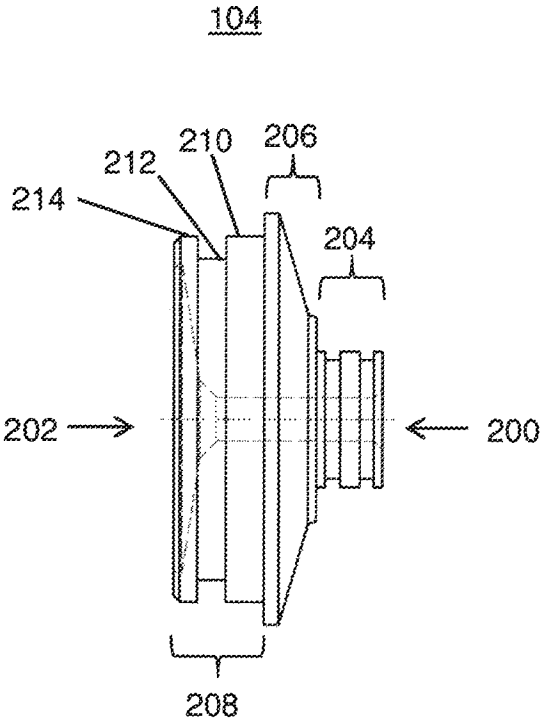

The specific features of the first filter holder piece 104 are shown in greater detail in FIGS. 2A, 2B, and 2C. The second end 202 of the first filter holder piece 104 fits within the first opening 310 of the first end 300 of the second filter holder piece 106. As seen in FIGS. 2A and 2B, the first filter holder piece 104 has a neck portion 204, a conical portion 206, and a base portion 208. The neck portion 204 is located at the first end 200 of the first filter holder piece 104, and the conical portion 206 is located adjacent to the neck portion 204 between the base portion 208 and the neck portion 204. An outer surface of the neck portion 204 has two circumferential grooves 118, 120 that are axially spaced apart from each other. Each circumferential groove 118, 120 is configured to receive an O-ring seal. The neck portion 204 slides into a similarly sized orifice in the smoking machine 800, and the two O-ring seals in the circumferential grooves 118, 120 create an air-tight seal between the smoke machine 800 and the first filter holder piece 104 (and consequently the cigar holder assembly 100).

As seen in FIGS. 2A and 2B, the depths of each of the two circumferential grooves 118, 120 are the same, but the depth of one groove could be different than the other. In an exemplary embodiment, each groove 118, 120 has a depth of 1 mm. However, the depth could be between 0.5 mm and 2 mm. In an exemplary embodiment, the diameter of the exterior surface of the neck portion 204 is 16.25 mm and the diameter of the circumferential grooves 118, 120 is 14.25 mm for both a filter holder designed for a 44 mm filter and a filter holder designed for a 55 mm filter.

There is an axially extending opening 220 that extends between the first end 200 and the second end 202. As seen in FIGS. 2A and 2B, the opening 220 flares outward at the first end 200 of first filter holder piece 104 and at the second end 202 of first filter holder piece 104. In between the two flared portions, the axially extending opening 220 has a constant diameter (for example, 5.25 mm for a filter holder designed for a 44 mm filter and 5.40 mm for a filter holder designed for a 55 mm filter holder). In an exemplary embodiment, the inner diameter of the flared opening 216 at the end of the neck portion 204 is 7.25 mm for a filter holder designed for a 44 mm filter and 7.40 mm for a filter holder designed for a 55 mm filter. In an exemplary embodiment, the diameter of the opening at the second end 202 is 36.75 mm for a filter holder designed for a 44 mm filter and 47.80 mm for a filter holder designed for a 55 mm filter holder.

In an exemplary embodiment, the base portion 208 includes a first cylindrical portion 210, a second cylindrical portion 212 (where the groove 122 is located), and a third cylindrical portion 214. The diameter of the first cylindrical portion 210 and the third cylindrical portion 214 is the same. In an exemplary embodiment, this diameter is 43.75 mm for a filter holder designed for a 44 mm filter and 55 mm for a filter holder designed for a 55 mm filter holder. An outer surface of the base portion 208 has the circumferential groove 122 that is configured to receive an O-ring seal configured to seal the base portion 208 in the first opening 310 of the second filter holder piece 106. As seen in FIGS. 2A and 2B, the diameter of the axially extending opening 220 increases at a position 218 in the base portion 208. Specifically, this position 218 is located in a section of the base portion 208 where the circumferential groove 122 is located.

In an exemplary embodiment, the axial length of the first filter holder piece 104 is 25 mm for a filter holder designed for a 44 mm filter and 30.25 mm for a filter holder designed for a 55 mm filter.

In an exemplary embodiment, the first filter holder piece 104 is made of polymer (e.g., ultra-high density polypropylene, etc.). However, the first filter holder piece 104 can be made of any material such as polymer, ceramic, and metal materials.

The specific features of the second filter holder piece 106 are shown in greater detail in FIGS. 3A, 3B, and 3C, and will be discussed next. The second filter holder piece 106 has a base portion 308 located at the first end 300 of the second filter holder piece 106, a neck portion 304 located at the second end 302 of the second filter holder piece 106, and a conical portion 306 located in between the base portion 308 and the neck portion 304 of the second filter holder piece 106. The base portion 308 of the second filter holder piece 106 has an axially extending base portion opening 310. The neck portion 304 of the second filter holder piece 106 has an axially extending neck portion exterior opening 312 that is located at the second end 302 of the second filter holder piece 106 and an axially extending neck portion interior opening 314 that is located in between the neck portion exterior opening 312 and the conical portion 306 of the second filter holder piece 106. The neck portion exterior opening 312 and the neck portion interior opening 314 are both circular, and the diameter of the neck portion exterior opening 312 is larger than the diameter of the neck portion interior opening 314.

In an exemplary embodiment, for a filter holder designed for a 44 mm filter pad, the diameter of the exterior surface of the neck portion 304 is 29.6 mm, the diameter of the neck portion exterior opening 312 is 25 mm, and the diameter of the neck portion interior opening 314 is 12 mm. In an exemplary embodiment, for a filter holder designed for a 55 mm filter pad, the diameter of the exterior surface of the neck portion 304 is 30 mm, the diameter of the neck portion exterior opening 312 is 25.5 mm, and the diameter of the neck portion interior opening 314 is 12 mm.

In an exemplary embodiment, for a filter holder designed for a 44 mm filter pad, the diameter of the exterior surface of the base portion 308 is 50.6 mm. In an exemplary embodiment, for a filter holder designed for a 44 mm filter pad, the diameter of the base portion opening 310 is 44.6 mm. The diameter of the flared opening 316 at the very end of the base portion 308 is 46.6 mm. In an exemplary embodiment, the axial length of the second filter holder piece 106 is 33 mm for a filter holder designed for a 44 mm filter pad. Specifically, the axial length of the base portion 308 is 13 mm, the axial length of the conical portion 306 is 7 mm, and the axial length of the neck portion 304 is 13 mm. The axial length of the base portion opening 310 is 8 mm and the axial length of the flared opening 316 is 1 mm.

In an exemplary embodiment, for a filter holder designed for a 55 mm filter pad, the diameter of the exterior surface of the base portion 308 is 61 mm. In an exemplary embodiment, for a filter holder designed for a 55 mm filter pad, the diameter of the base portion opening 310 is 54.8 mm. The diameter of the flared opening 316 at the very end of the base portion 308 is 56.4 mm. In an exemplary embodiment, the axial length of the second filter holder piece 106 is 32.5 mm for a filter holder designed for a 55 mm filter pad. Specifically, the axial length of the base portion 308 is 13.5 mm, the axial length of the conical portion 306 is 6.15 mm, and the axial length of the neck portion 304 is 12.85 mm. The axial length of the base portion opening 310 is 7.75 mm and the axial length of the flared opening 316 is 0.33 mm.

In an exemplary embodiment, the second filter holder piece 106 is made of plastic. For example, ultra-high density plastic. However, the first filter holder piece 106 can be made of any material such as polymer, ceramic, and metal materials.

The specific features of the cigar holder 110 are shown in greater detail in FIGS. 5A, 5B, and 5C, and will be discussed next. The cigar holder 110 includes a base portion 504, a tapered portion 506, and a lipped portion 508. The cigar holder 110 has an axially extending opening 512 in a first end 500 of the cigar holder 110 and an axially extending opening 510 in the second end 502 of the cigar holder 110. The opening 512 and the opening 510 are both circular. The seal 108 fits within the opening 512 in the first end 500 of the cigar holder 110. The tapered portion 506 has an outer periphery which becomes smaller in a direction towards the lipped portion 508. In an exemplary embodiment, the diameter of the base portion 504 is the same as the diameter of the lipped portion 508. However, the diameter of the base portion 504 can be different than the diameter of the lipped portion 508. The outer surface of the base portion 504 of the cigar holder 110 has a circumferential groove 124 configured to receive an O-ring. The first end 500 of the cigar holder 110 fits within the neck portion exterior opening 312 of the second filter holder piece 106. The size of the neck portion exterior opening 312 corresponds to the size of the first end 500 of the cigar holder 110, and an O-ring in the circumferential groove 124 causes an air-tight seal between these two components. In an exemplary embodiment, the cigar holder 110 is made of plastic. However, the cigar holder 110 can be made of any material such as polymer, ceramic, or metal materials.

In an exemplary embodiment, the diameter of the axially extending opening 512 is larger than the axially extending opening 510. In an exemplary embodiment, the axially extending opening 510 flares outward at the second end 502 such that the diameter of the axially extending opening 510 is larger at the second end 502 than in the middle of the axially extending opening 510 that is located in the middle of the cigar holder 110. For example, the diameter of the axially extending opening 510 at the second end 502 can be 14 mm and the diameter at the middle of the axially extending opening 510 can be 12 mm. The diameter of the axially extending opening 512 can be 18.5 mm. The diameter of the exterior surface of the base portion 504 can be 25 mm, and the diameter of the exterior surface of the lipped portion 508 can be 25 mm. In an exemplary embodiment, the overall axial length of the cigar holder 110 can be 23.5 mm. Specifically, the axial length of the base portion 504 can be 8.15 mm, the axial length of the tapered portion 506 can be 10.35 mm, and the axial length of the lipped portion 508 can be 5 mm. The dimensions of the cigar holder 110 can be increased to accommodate tipped cigars with larger dimensions.

Figure 4C:
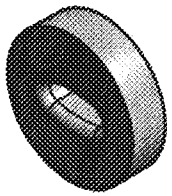
FIGS. 4A-4C illustrate a seal for plastic-tipped cigars in accordance with an exemplary embodiment.
Figure 4B:
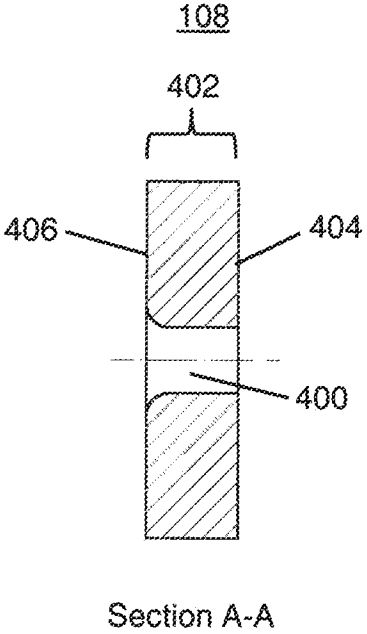
Figure 4A:
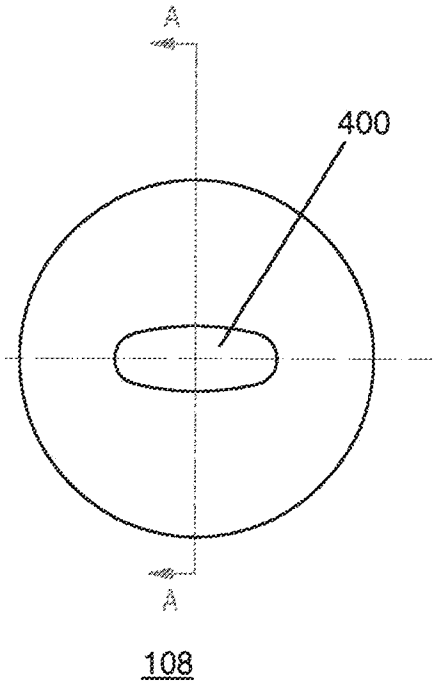
Figure 4F:
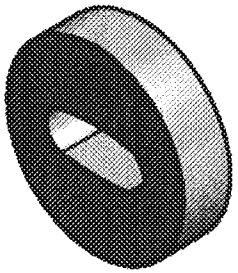
FIGS. 4D-4F illustrate a seal for wood-tipped cigars in accordance with an exemplary embodiment.
Figure 4E:
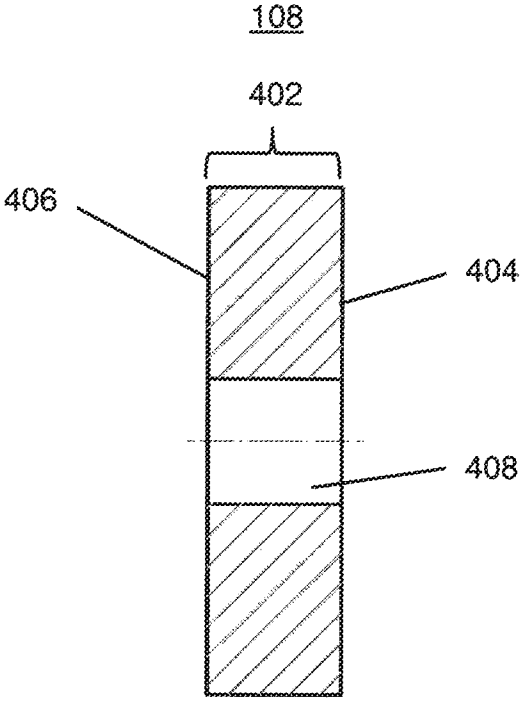
Figure 4D:
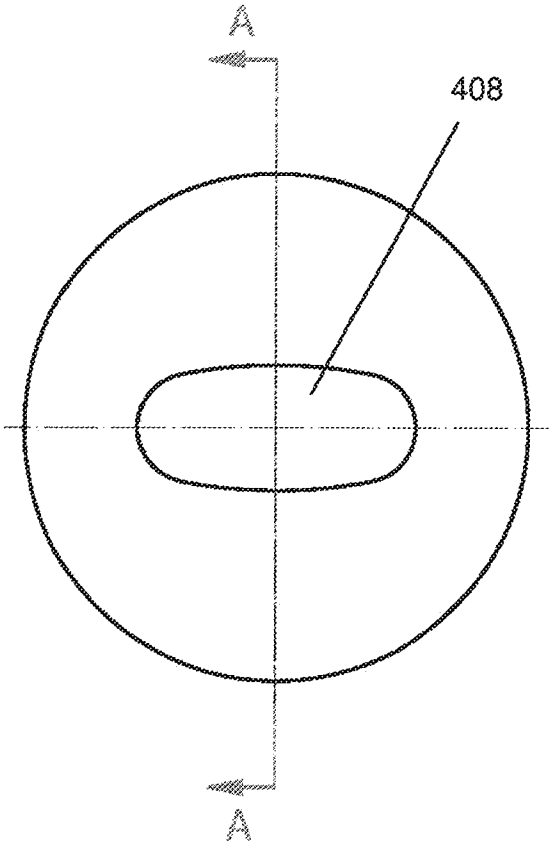

The specific features of the seal 108 are shown in greater detail in FIGS. 4A, 4B, 4C, 4D, 4E, and 4F, and will be discussed next. FIGS. 4A, 4B, and 4C show an exemplary seal used for plastic-tipped cigars, and FIGS. 4D, 4E, and 4F show an exemplary seal used for wood-tipped cigars. The opening 400, 408 of the seal 108 is oval-shaped in FIGS. 4A, 4B, 4C, 4D, 4E, and 4F. However, the oval opening 400 for the seal 108 for plastic-tipped cigars (FIG. 4A) is narrower than the oval opening 408 for the seal 108 for wood-tipped cigars (FIG. 4D). This is because the plastic tips are thinner and more flat than the wood tips. As seen in FIGS. 4B and 4C, the oval opening 400 of the seal 108 for plastic-tipped cigars is flared outwardly at the second end 406 of the seal 108. The flared opening 400 is larger on the second end 406 of the seal 108 (i.e., the side of the seal that accepts the cigar tip) than a corresponding width of the opening 400 on the first end 404 of the seal 108. In other words, the opening 400 flares outward from the center in all directions on the second end 406 of the seal 108. However, there is a portion of the opening 400 that is not flared. The outside diameter of the seal 108 can be larger than the thickness 402 of the seal 108. In an exemplary embodiment, the diameter of the seal 108 for plastic and wood-tipped cigars can be 19.05 mm. The thickness of the seal 108 for plastic and wood-tipped cigars can be 5 mm. The width of the opening 400 of the seal 108 for plastic-tipped cigars can be 8.73 mm at its widest point, and the height of the opening 400 at its largest point can be 3.5 mm.

As seen in FIGS. 4E and 4F, the oval opening 408 of the seal 108 for wood-tipped cigars has constant dimensions along the axial direction of the seal 108. The width of the opening 408 of the seal 108 for wood-tipped cigars can be 10.5 mm at its widest point, and the height of the opening 400 at its largest point can be 4.7 mm.

In an exemplary embodiment, the seal 108 can be made of an elastomeric material such as rubber, silicone, etc.

In an exemplary embodiment, the cigar holder 110 includes the first end 500 that has the opening 512 that is configured to receive the seal 108 that is cylindrically shaped. The cigar holder 110 also includes the second end 502 that has the opening 510 that is configured to receive a tipped cigar. The second end 502 is opposite to the first end 500. The cigar holder 110 further includes the base portion 504 that is located at the first end 500, and an outer surface of the base portion 504 has the circumferential groove 124 that is configured to receive an O-ring. The cigar holder 110 includes the lipped portion 508 that is located at the second end 502, and the tapered portion 506 that is located in between the base portion 504 and the lipped portion 508. The tapered portion 506 has an outer periphery which becomes smaller in a direction towards the lipped portion 508, and the first end 500 is configured to fit within the opening 312 in the filter holder 102.

In an exemplary embodiment, the cigar holder assembly 100 for a tipped cigar can be designed with the appropriate angles and distances such that when the cigar is inserted 28 mm, there is a distance of 12 mm from the mouth end of the cigar to the Cambridge filter pad.

Figure 1B:
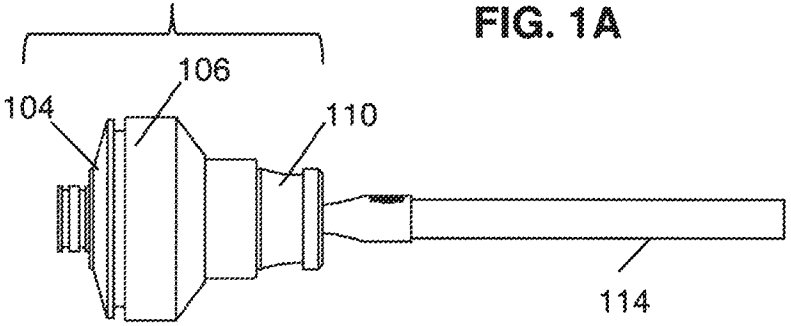
Figure 1C:
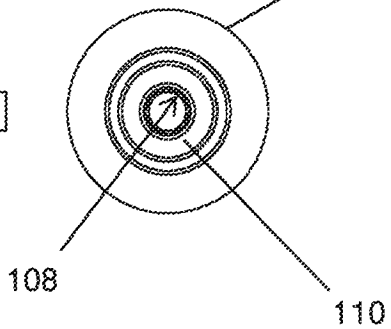

The cigar holder assembly 100 is assembled together by first placing an O-ring seal in each of the circumferential grooves 118, 120, 122, and 124. Next, a Cambridge filter pad is placed flush against the second end 202 of the first filter holder piece 104, and then the second end 202 of the first filter holder piece 104 is inserted into the first end 300 of the second filter holder piece 106 as shown in FIGS. 1A and 1B. Next, a seal 108 with an opening 400 is selected if a plastic-tipped cigar is to be tested or a seal 108 with an opening 408 is selected if a wood-tipped cigar is to be tested. The seal 108 is inserted all the way into the opening 512 of the cigar holder 110. Next, the cigar holder 110 (with the seal 108 seated therein) is connected to the second filter holder piece 106. Specifically, the first end 500 of the cigar holder 110 is inserted within the neck portion exterior opening 312 of the second filter holder piece 106 as seen in FIG. 1B. The cigar holder assembly 100 is now assembled and is attached to the smoking machine 800 via the neck portion 204 of the first filter holder piece 104. Specifically, the first filter holder piece 104 is inserted into an orifice (port) of the smoking machine 800. The tipped portion 116 of the cigar is inserted into the opening 510 in the cigar holder 110, and consequently the tipped portion 116 is inserted into the opening 400 or 408 in the seal 108. The tipped portion 116 is inserted a predetermined amount so that there is a set distance from the end of the tipped portion 116 to the Cambridge filter pad within the filter holder 102. For example, the tipped portion 116 is inserted 28 mm, so that there is a distance of 12 mm from the tipped portion 116 of the cigar to the Cambridge filter pad.

Once the cigar holder assembly 100 is connected to the smoking machine and the cigar is inserted into the cigar holder assembly 100 as described above, machine smoking of cigar by the smoking machine can be started via a computer controlled user-interface. Various smoking regimes can be selected using the user-interface in which the user can customize the smoking. For example, puff duration, volumes, and interval are all variable and user controlled. The smoking machine can be designed specifically for smoking cigars to, for example, CORESTA recommended methods #64, #65, #66, #67, etc. The cigar is cut, for example, with a straight cut at a position 5 mm from the mouth end. The cigar is lit, and allowed to burn down to a specified distance from the cigar holder 110. For example, a puff termination device linked to a butt length (mark) sensor and a puff counter can be used. When activated by the sensor, the puff termination device prevents any further drawing of air through the cigar. Particulate matter present in the mainstream smoke is captured by the Cambridge filter pad that is contained within the filter holder 102. The smoking machine can also have a built-in gas analyzer that can collect and analyze carbon monoxide generated during the smoking. After the smoking of the cigar is completed, the Cambridge filter pad is removed from the filter holder 102, and the particulate matter from the mainstream smoke is analyzed by a laboratory. The results of the analysis can be used, for example, to determine consistency in the manufacturing of the cigars, for inter-brand comparison, etc. Multiple cigars can be tested at a time on a smoking machine with multiple ports.

In an exemplary embodiment, a similar cigar holder assembly as described above can be used for untipped cigars. The cigar holder assembly for untipped cigars can use a first filter holder piece and a second filter holder piece that are similar to those described above, and a cigar holder that is similar to the cigar holder described above. The dimensions, angles, and shapes of these components can be modified for optimal flow of smoke from an untipped cigar. For example, the cigar holder assembly for an untipped cigar can be designed with the appropriate angles and distances such that when the cigar is inserted 28 mm, there is a distance of 12 mm from the mouth end of the cigar to the Cambridge filter pad.

Figure 6B:
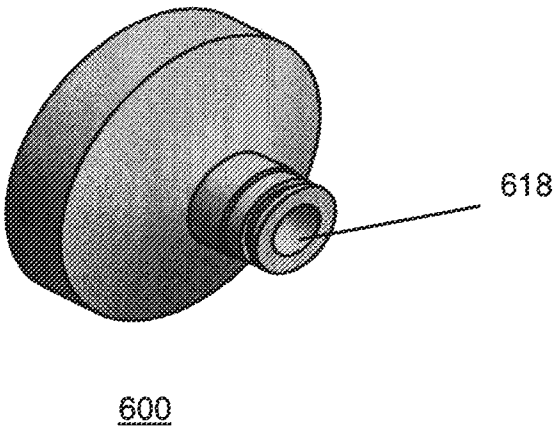
FIGS. 6A-6B illustrate a second filter holder piece in accordance with an exemplary embodiment.
Figure 6A:
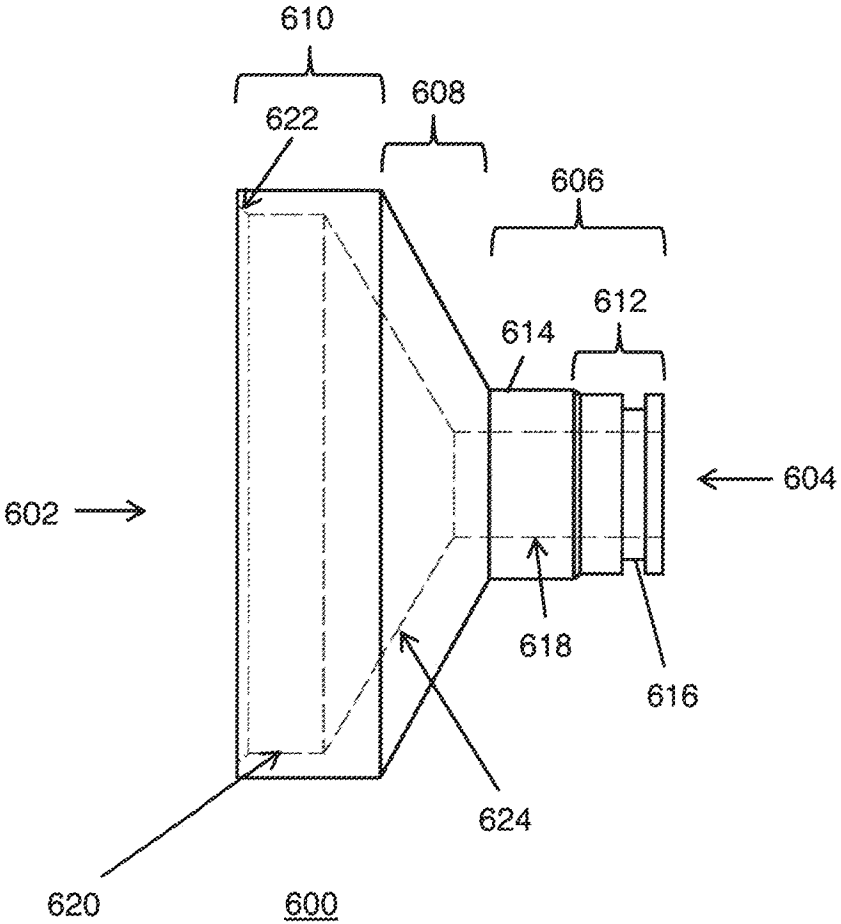

FIGS. 6A and 6B show an exemplary embodiment of a second filter holder piece 600 used for untipped cigars. The other filter holder piece used with the second filter holder piece 600 to form a filter holder for use with untipped cigars can have the same shape and design as the first filter holder piece 104 shown in FIGS. 2A-2C. The second filter holder piece 600 has a first end 602 and a second end 604 that is opposite to the first end 602. The second filter holder piece 600 has a base portion 610 located at the first end 602 of the second filter holder piece 600, a neck portion 606 located at the second end 604 of the second filter holder piece 600, and a conical portion 608 located in between the base portion 610 and the neck portion 606 of the second filter holder piece 600. The base portion 610 of the second filter holder piece 600 has an axially extending base portion opening 620. The neck portion 606 of the second filter holder piece 600 has an axially extending neck portion opening 618 that is located at the second end 604 of the second filter holder piece 600 and a conical intermediate opening 624 that is located in between the neck portion opening 618 and the base portion opening 620. The neck portion opening 618 and the base portion opening 620 are both cylindrical recesses, and the diameter of the neck portion opening 618 is smaller than the diameter of the base portion opening 620. The base portion opening 620 is connected to a flared (chamfered) opening 622 in the base portion 610. The intermediate opening 624 flares outward from the neck portion opening 618 towards the base portion opening 620. The neck portion 606 is made up of two sections, i.e. a distal section 612 and an intermediate section 614. The distal section 612 includes a circumferential groove 616 that is configured to receive an O-ring seal. The distal section 612 is configured to receive a first end 702 of a cigar holder 700 that is used for untipped cigars.

In an exemplary embodiment, for a filter holder for untipped cigars that is designed for a 55 mm filter pad, the diameter of the exterior surface of the distal section 612 can be 18.6 mm, the diameter of the exterior surface of the intermediate section 614 can be 19.6 mm, and the diameter of the neck portion opening 618 can be 10.9 mm. In an exemplary embodiment, the diameter of the circumferential groove 616 can be 15.6 mm. In an exemplary embodiment, for a filter holder designed for a 55 mm filter pad, the diameter of the exterior surface of the base portion 610 can be 60.9 mm. In an exemplary embodiment, for a filter holder designed for a 55 mm filter pad, the diameter of the base portion opening 620 can be 55.9 mm. The diameter of the flared opening 622 at the very end of the base portion 610 can be 57.9 mm.

In an exemplary embodiment, for a filter holder for untipped cigars that is designed for a 44 mm filter pad, the diameter of the exterior surface of the distal section 612 can be 18.6 mm, the diameter of the exterior surface of the intermediate section 614 can be 19.0 mm, and the diameter of the neck portion opening 618 can be 11.0 mm. In an exemplary embodiment, the diameter of the circumferential groove 616 can be 15.6 mm. In an exemplary embodiment, for a filter holder designed for a 44 mm filter pad, the diameter of the exterior surface of the base portion 610 can be 50.5 mm. In an exemplary embodiment, for a filter holder designed for a 44 mm filter pad, the diameter of the base portion opening 620 can be 44.5 mm. The diameter of the flared opening 622 at the very end of the base portion 610 can be 46.5 mm.

In an exemplary embodiment, the axial length of the second filter holder piece 600 for untipped cigars can be 37.75 mm for a filter holder designed for a 55 mm filter pad. Specifically, the axial length of the base portion 610 can be 12.8 mm, the axial length of the conical portion 608 can be 9.55 mm, and the axial length of the neck portion 606 can be 15.4 mm. The axial length of the intermediate section 614 can be 7.5 mm and the axial length of the distal section 612 can be 7.9 mm. The axial length of the base portion opening 620 can be 6.7 mm and the axial length of the flared opening 622 can be 1 mm.

In an exemplary embodiment, the axial length of the second filter holder piece 600 for untipped cigars can be 37 mm for a filter holder designed for a 44 mm filter pad. Specifically, the axial length of the base portion 610 can be 13.8 mm, the axial length of the conical portion 608 can be 10.75 mm, and the axial length of the neck portion 606 can be 12.45 mm. The axial length of the intermediate section 614 can be 4.25 mm and the axial length of the distal section 612 can be 8.2 mm. The axial length of the base portion opening 620 can be 7 mm and the axial length of the flared opening 622 can be 1 mm.

In an exemplary embodiment, the second filter holder piece 106 is made of plastic. For example, ultra-high density plastic. However, the first filter holder piece 106 can be made of any material such as polymer, ceramic, and metal materials.

Figure 7C:
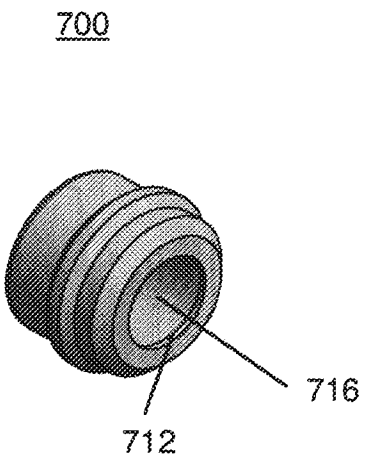
FIGS. 7A-7C illustrate a cigar holder in accordance with an exemplary embodiment.
Figure 7B:
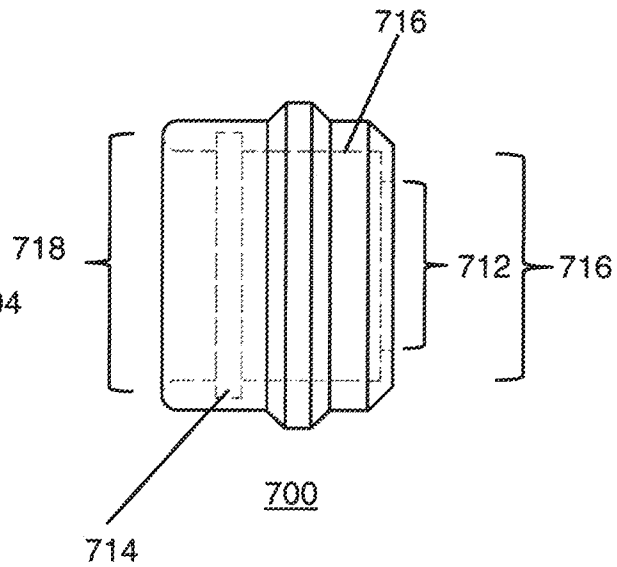
Figure 7A:
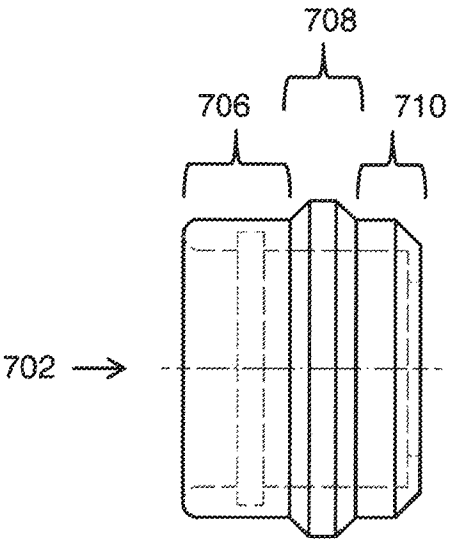

FIGS. 7A-7C show an exemplary embodiment of a cigar holder 700 used for untipped cigars. The cigar holder 700 used for untipped cigars has a first end 702 and a second end 704 that is configured to receive an untipped cigar end. The second end 704 is opposite to the first end 702. An axially extending opening 716 is located between the first end 702 and the second end 704. The second end 604 of the second filter holder piece 600 for untipped cigars and the first end 702 of the cigar holder 700 for untipped cigars are configured to fit together.

The cigar holder 700 includes a base portion 706, an intermediate portion 708, and an end portion 710. The cigar holder 700 has a flared opening 718 in the first end 702 of the cigar holder 700 and an axially extending opening 712 in the second end 704 of the cigar holder 700. The flared opening 718, the opening 716, and the opening 712 are all circular. The diameter of the opening 712 is smaller than the diameter of the axially extending opening 716. The base portion 706 includes a circumferential groove 714 located in its interior within the axially extending opening 716. The circumferential groove 714 is configured to receive an O-ring seal. In an exemplary embodiment, the diameter of the base portion 706 is the same as the diameter of a portion of the end portion 710. The section of the end portion 710 located at the second end 704 has an angled surface as seen in FIGS. 7A-7C. In an exemplary embodiment, the intermediate portion 708 has a diameter that is larger than the diameter of the base portion 706 and the end portion 710. In an exemplary embodiment, the intermediate portion 708 has two angled surfaces. The larger diameter of the intermediate portion 708 makes it easier to separate the cigar holder 700 from the second filter holder piece 600.

The first end 702 of the cigar holder 700 fits over the distal section 612 of the neck portion 606 of the second filter holder piece 600 for untipped cigars. The size of the distal section 612 of the neck portion 606 corresponds to the size of the opening 715 in the cigar holder 700. An O-ring seal is placed in the circumferential groove 616 of the second filter holder piece 600, and the flared opening 718 allows the O-ring to seat into the circumferential groove 714 when the cigar holder 700 is positioned onto the distal section 612 of the second filter holder piece 600. The O-ring in the circumferential grooves 714 and 616 provides for an air-tight seal between these two components. In an exemplary embodiment, the cigar holder 700 is made of plastic. However, the cigar holder 110 can be made of any material such as polymer, ceramic, or metal materials.

In an exemplary embodiment, the diameter of the axially extending opening 712 at the second end 704 can be 14 mm and the diameter of the axially extending opening 716 can be 19 mm. The diameter of the flared opening 718 can be 22 mm. The diameter of the exterior surface of the base portion 706 can be 24 mm, and the diameter of the exterior surface of the flat section of the end portion can be 24 mm. The diameter of the exterior surface of the intermediate portion 708 can be 27 mm. In an exemplary embodiment, the overall axial length of the cigar holder 700 can be 18.25 mm. Specifically, the axial length of the base portion 706 can be 8.25 mm, the axial length of the intermediate portion 708 can be 5 mm, and the axial length of the end portion 710 can be 5 mm. The axial length of the opening 712 can be 1 mm and the axial length of the flared opening 718 combined with the opening 716 can be 17.25 mm.

In an exemplary embodiment, the cigar holder assembly for untipped cigars does not use a seal similar to the seal 108 used in the cigar holder assembly 100 for tipped cigars. Instead, the cigar holder 700 can use a labyrinth seal with the seal orifice punched out to 1 mm less than the diameter of the intended cigar. The dimensions of the cigar holder 700 can be increased to accommodate untipped cigars with larger dimensions.

The description of the embodiments described herein are intended to provide a general understanding of the structure of the various embodiments. Many other embodiments may be apparent to those of skill in the art upon reviewing the disclosure.

What is claimed:

1. A cigar holder assembly configured to connect to a smoking machine, the cigar holder assembly comprising:

a filter holder that includes:

a first filter holder piece having a first end that is configured to connect to a smoking machine and a second end that is opposite the first end, and an axially extending opening between the first end and the second end, and a second filter holder piece having a first end and a second end that is opposite the first end, a first opening extending axially into the first end and a second opening extending axially into the second end, and the second end of the first filter holder piece and the first end of the second filter holder piece configured to fit together to form a chamber for a filter;

a cigar holder having a first end and a second end that is configured to receive a cigar having a tipped end, the second end is opposite to the first end, an axially extending opening between the first end and the second end, and the second end of the second filter holder piece and the first end of the cigar holder configured to fit together;

a seal that is cylindrically shaped and has an axially extending opening in the center thereof that extends through the entire thickness of the seal, the seal configured to fit in the opening in the first end of the cigar holder, and the opening in the seal configured to support a tipped end of a cigar; and wherein the cigar holder includes a base portion, a tapered portion, and a lipped portion, and the tapered portion has an outer periphery which becomes smaller in a direction towards the lipped portion.

2. The cigar holder assembly of claim 1, wherein the second end of the first filter holder piece fits within the first opening of the first end of the second filter holder piece.

3. The cigar holder assembly of claim 1, wherein the first filter holder piece has a neck portion, a conical portion, and a base portion, and wherein the neck portion is located at the first end of the first filter holder piece, and the conical portion is located adjacent to the neck portion between the base portion and the neck portion.

4. The cigar holder assembly of claim 3, wherein an outer surface of the neck portion has two circumferential grooves that are axially spaced apart from each other, and each circumferential groove is configured to receive an O-ring seal.

5. The cigar holder assembly of claim 3, wherein an outer surface of the base portion has a circumferential groove that is configured to receive an O-ring seal configured to seal the base portion in the first opening of the second filter holder piece.

6. The cigar holder assembly of claim 1, wherein the second filter holder piece has a base portion located at the first end of the second filter holder piece, a neck portion located at the second end of the second filter holder piece, and a conical portion located in between the base portion and the neck portion of the second filter holder piece.

7. The cigar holder assembly of claim 6, wherein the base portion of the second filter holder piece has an axially extending base portion opening, and the neck portion of the second filter holder piece has an axially extending neck portion exterior opening that is located at the second end of the second filter holder piece and an axially extending neck portion interior opening that is located in between the neck portion exterior opening and the conical portion of the second filter holder piece.

8. The cigar holder assembly of claim 7, wherein the neck portion exterior opening and the neck portion interior opening are both circular, and the diameter of the neck portion exterior opening is larger than the diameter of the neck portion interior opening.

9. The cigar holder assembly of claim 8, wherein the seal fits within the opening in the first end of the cigar holder.

10. The cigar holder assembly of claim 9, wherein the first end of the cigar holder fits within the neck portion exterior opening of the second filter holder piece.

11. A cigar holder assembly configured to connect to a smoking machine, the cigar holder assembly comprising:

a filter holder that includes:

a first filter holder piece having a first end that is configured to connect to a smoking machine and a second end that is opposite the first end, and an axially extending opening between the first end and the second end, and a second filter holder piece having a first end and a second end that is opposite the first end, a first opening extending axially into the first end and a second opening extending axially into the second end, and the second end of the first filter holder piece and the first end of the second filter holder piece configured to fit together to form a chamber for a filter;

a cigar holder having a first end and a second end that is configured to receive a cigar having a tipped end, the second end is opposite to the first end, an axially extending opening between the first end and the second end, and the second end of the second filter holder piece and the first end of the cigar holder configured to fit together; and a seal that is cylindrically shaped and has an axially extending opening in the center thereof that extends through the entire thickness of the seal, the seal configured to fit in the opening in the first end of the cigar holder, and the opening in the seal configured to support a tipped end of a cigar, wherein the opening of the seal is oval-shaped.

12. The cigar holder assembly of claim 1, wherein the opening of the seal has a varying width along an axial direction of the seal.

13. The cigar holder assembly of claim 12, wherein a width of the opening is larger on the second end of the seal than a corresponding width of the opening on the first end of the seal.

14. The cigar holder assembly of claim 1, wherein the diameter of the seal is larger than the thickness of the seal.

15. The cigar holder assembly of claim 1, wherein the seal is made of an elastomeric material.

16. The cigar holder assembly of claim 15, wherein the elastomeric material is rubber or silicone.

17. The cigar holder assembly of claim 1, wherein the diameter of the base portion is the same as the diameter of the lipped portion.

18. The cigar holder assembly of claim 1, wherein an outer surface of the base portion of the cigar holder has a circumferential groove configured to receive an O-ring.

19. A cigar holder comprising:

a first end that has an opening that is configured to receive a seal that is cylindrically shaped;

a second end that has an opening that is configured to receive a cigar, wherein the second end is opposite to the first end;

a base portion that is located at the first end, an outer surface of the base portion has a circumferential groove configured to receive an O-ring;

a lipped portion that is located at the second end; and a tapered portion that is located in between the base portion and the lipped portion, wherein the tapered portion has an outer periphery which becomes smaller in a direction towards the lipped portion, and wherein the first end is configured to fit within an opening in a filter holder and wherein the cigar holder includes a base portion, a tapered portion, and a lipped portion, and the tapered portion has an outer periphery which becomes smaller in a direction towards the lipped portion.

* * * * *